US006940049B2

(12) United States Patent
Harwell et al.

(10) Patent No.: US 6,940,049 B2
(45) Date of Patent: Sep. 6, 2005

(54) HEATING ELEMENT TEMPERATURE CONTROL FOR A COOKING APPLIANCE

(75) Inventors: Virginia L. Harwell, Anniston, AL (US); Issac P. Sargunam, Cleveland, TN (US); Kenneth E. Sauter, Ooltewah, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/624,466

(22) Filed: Jul. 23, 2003

(65) Prior Publication Data

US 2005/0016988 A1 Jan. 27, 2005

(51) Int. Cl.[7] ..... H05B 3/02; H05B 3/69
(52) U.S. Cl. ..... 219/482; 219/448.12
(58) Field of Search ..... 219/482, 483, 219/486, 487, 489, 490, 492, 448.12, 448.13, 460.1, 465.1

(56) References Cited

U.S. PATENT DOCUMENTS 4,410,795 A * 10/1983 Ueda ..... 219/492
4,486,648 A 12/1984 Grasso
4,493,980 A 1/1985 Payne et al.
4,692,596 A 9/1987 Payne
4,737,617 A 4/1988 Payne
4,772,779 A 9/1988 Scheidler et al.
4,786,799 A * 11/1988 Welle et al. ..... 219/486
4,816,647 A 3/1989 Payne
4,994,652 A 2/1991 Wolf et al.
5,293,028 A 3/1994 Payne
5,746,114 A 5/1998 Harris
6,236,025 B1 5/2001 Berkcan et al.
6,255,630 B1 7/2001 Barnes et al.

* cited by examiner

*Primary Examiner*—Sang Paik
(74) *Attorney, Agent, or Firm*—Diederiks & Whitelaw, PLC; Allan P. Orsund

(57) ABSTRACT

A cooking appliance includes a cooktop having at least one heating element, a controller and a control element linked to the controller and associated with operation of the heating element. Specifically, the control element includes first and second operational setting schemes which provide a consumer with a higher degree of control over operation of the heating element. More specifically, selection of the first scheme operates the heating element at a selected level, while selection of the second scheme causes the heating element to operate at an initial high level and then to automatically convert to a lower level.

18 Claims, 3 Drawing Sheets

HEATING ELEMENT TEMPERATURE CONTROL FOR A COOKING APPLIANCE

BACKGROUND OF THE INVENTION

1. Field of the Invention

The present invention pertains to the art of cooking appliances and, more particularly, to a cooking appliance including a cooktop having at least one heating element and a controller for automatically operating the at least one heating element at multiple power levels.

2. Discussion of the Prior Art

In general, establishing a selected power level for a heating element in a cooking appliance is known. However, maintaining the selected power level for the entire duration of a cooking process is not always desirable. Specifically, when cooking rice, pasta or other liquid based food items, it is often necessary to bring a liquid to a boil using an initial, high power setting and thereafter simmer at a second or lower power setting for a prescribed period. In today's fast paced society, there is seldom time to continuously monitor the contents of a pot. Often times the pot will boil over, causing the contents to run onto the heated surface(s) of a stove. Other times, the pot is left to boil for so long that the contents boil away leaving behind a charred mess.

The prior art teaches a variety of methods for providing a more convenient means of cooking food on a cooktop. One example is provided by U.S. Pat. No. 5,746,114 disclosing an intelligent cooking system. The cooking system includes various cooking implements, such as pots and pans, each having an associated temperature monitor. The system also includes a cooktop having a plurality of burners and a controller that is linked between the cooktop and the temperature monitors to maintain a desired temperature in the associated pot or pan. While effective, this system is large, complex and expensive. In the highly competitive field of cooking appliances, increased cost and complexity can be significant, disadvantageous features.

Another method disclosed in the prior art is embodied in U.S. Pat. No. 6,236,630 directed to an acoustic sensing system for detecting boiling in a particular cooking implement. As disclosed, an acoustic sensor is mounted in a cooktop range and configured to detect acoustic frequencies that are characteristic of emissions resulting from heating and boiling of water. While effective to a large extent, not all cooking processes include a boiling stage. In addition, as with the previous method, there are both high costs and reliability concerns with this system.

Based on the above, there exists a need in the art for a cooking appliance including a cooktop and a controller capable of establishing multiple power levels for at least one heating element of the cooktop, with each power level having an associated time duration of operation. More specifically, there exists a need for a cooking appliance having a controller that can establish an initial high power level for a first time period of a cooking operation and then automatically lower to a second power level for the remainder of the cooking operation.

SUMMARY OF THE INVENTION

The present invention is directed to a cooking appliance including a cooktop. The cooking appliance further includes at least one heating element arranged on the cooktop, a controller, and a control element which is linked to both the controller and the heating element. Through initial operation of the control element, the heating element is automatically sequenced through multiple power levels throughout a cooking operation.

In accordance with a preferred embodiment of the present invention, the control element includes a plurality of consecutive, numeric digits which combine to define first and second operational setting schemes. Preferably, even numbered digits are associated with the first operational setting scheme and odd numbered digits are associated with the second operational setting scheme. More specifically, selection of an even numbered power level establishes a temperature for the at least one heating element, with that temperature corresponding to the particular even number. In contrast, selection of an odd numbered power level provides a consumer the ability to further control the temperature of the at least one heating element automatically during a cooking operation.

In accordance with the most preferred form of the present invention, selection of the second operational setting scheme enables the consumer to establish an initial power level, which is greater than the selected power level, for the at least one heating element. That is, selection of an odd numbered digit enables the consumer to actually establish a second, higher power level wherein the at least one heating element is operated at the higher power level for a predetermined time period, after which the controller automatically lowers the temperature of the at least one heating element to the selected power level. Preferably, the higher power level is maintained for a time period in a range of 5–10 minutes thereby providing a faster heat-up time without requiring further manipulation of the control element.

In further accordance with the most preferred form of the present invention, the cooking appliance includes a control unit having a graphics display. The graphics display is linked to each of the controller and the control element. The display provides the consumer with a visual indication that the heating element in operating in accordance with the second setting scheme. More specifically, the display will inform the consumer when the heating element is operating at the initial or second, higher power level.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
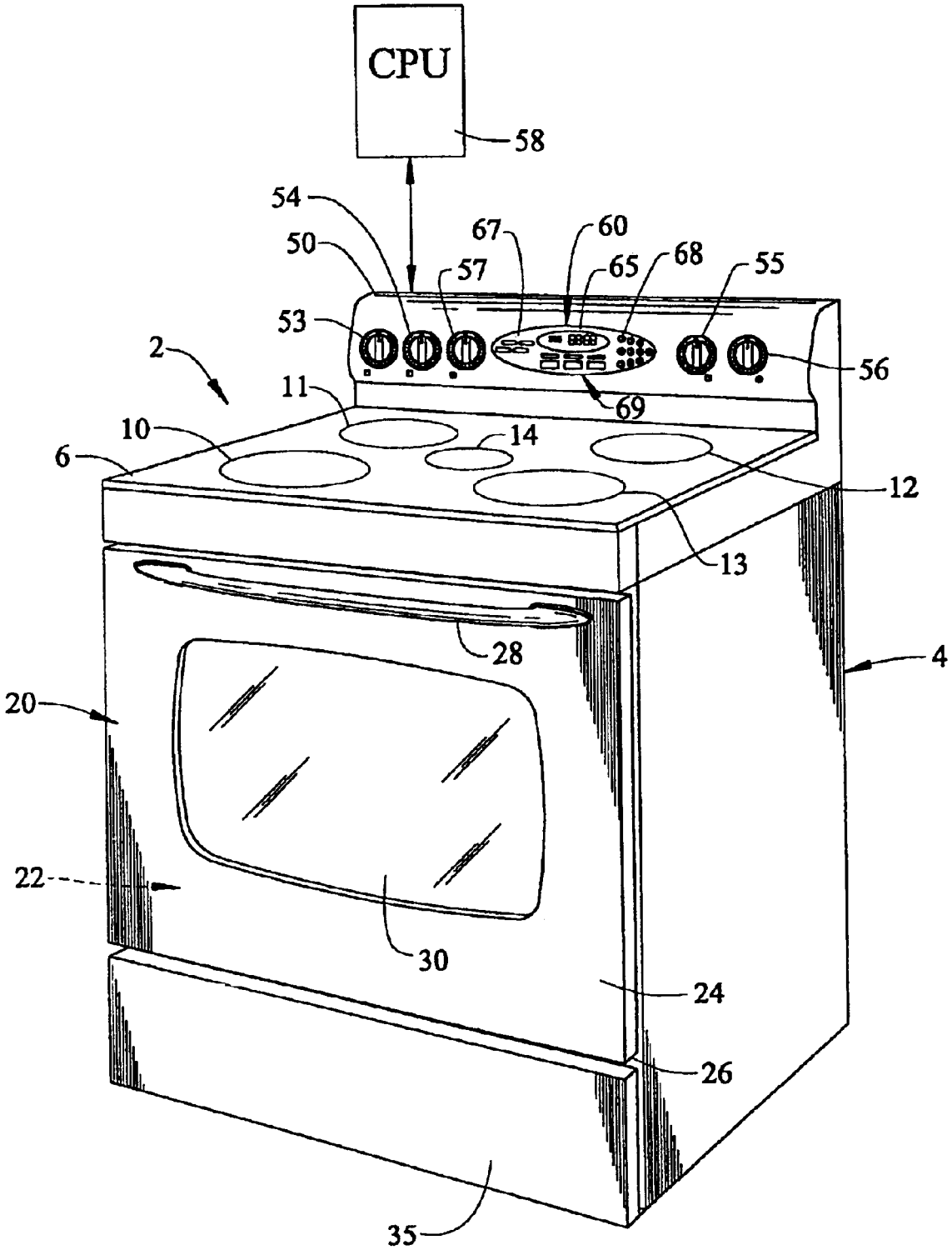
FIG. 1 is an upper right perspective view of a cooking appliance including a cooktop having a plurality of control elements arranged on a control panel constructed in accordance with the present invention.

With initial reference to FIG. 1, a cooking appliance 2, generally taking the form of an oven range, includes a cabinet shell 4 provided with a cooktop 6. As illustrated, appliance 2 constitutes a free-standing electric range such that cooktop 6 is provided with a plurality of electric heating elements or zones 10–14. At this point, it should be noted that although appliance 2 is shown to constitute a free-standing range, the invention is equally applicable to various other types of cooking appliances including slide-in ranges, kitchen counter cooktops and the like.

In a preferred embodiment, appliance 2 includes an oven 20 having an interior oven cavity 22. In a manner known in the art, oven 20 has associated therewith a door 24 which can be pivoted at a lower portion 26 by means of a handle 28. Door 24 preferably includes a window or transparent zone 30 for viewing the contents of oven 20 when door 24 is closed. In a manner also known in the art, appliance 2 includes a drawer or bin 35 arranged below oven 20. More specifically, drawer or bin 35 is adapted to be slid in and out of shell 4 in order to access an interior storage compartment (not shown) therein.

Figure 2:
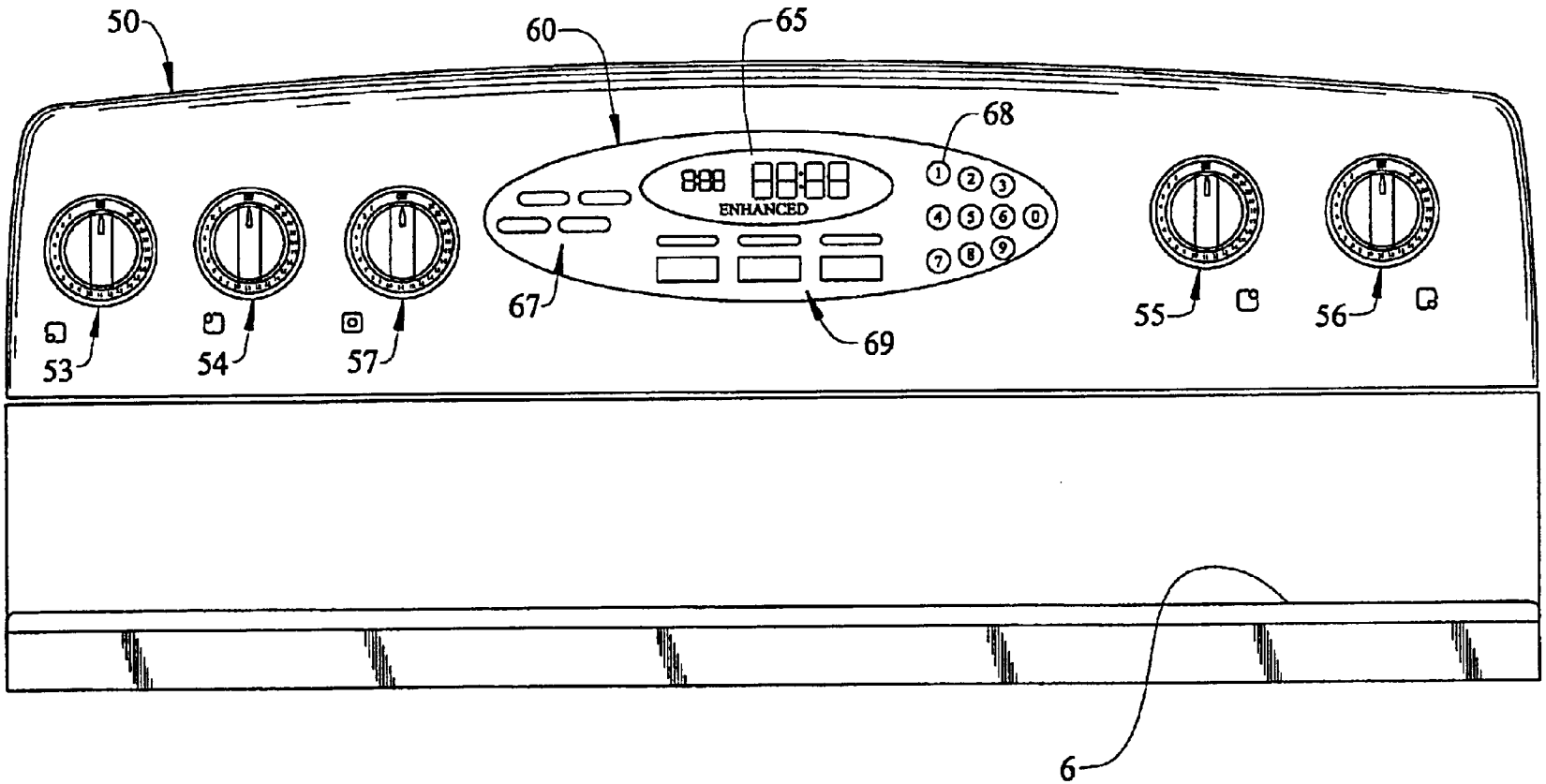
FIG. 2 is an enlarged plan view of the control panel and a plurality of control elements of FIG. 1.

In the preferred embodiment as best shown in FIGS. 1 and 2, cooking appliance 2 includes a control panel 50 having arranged thereon a plurality of control elements 53–57 which, as will be discussed more fully below, interact with a controller 58 to set a desired power level for heating elements 10–14 respectively. Control panel 50 further includes a central display 60 including a digital display portion 65, a plurality of oven control buttons generally indicated at 67 arranged on one side of central display 60, a numeric keypad 68 arranged on an opposite side of central display 60, and a plurality of mode select buttons 69 arranged below digital display 65.

Figure 3:
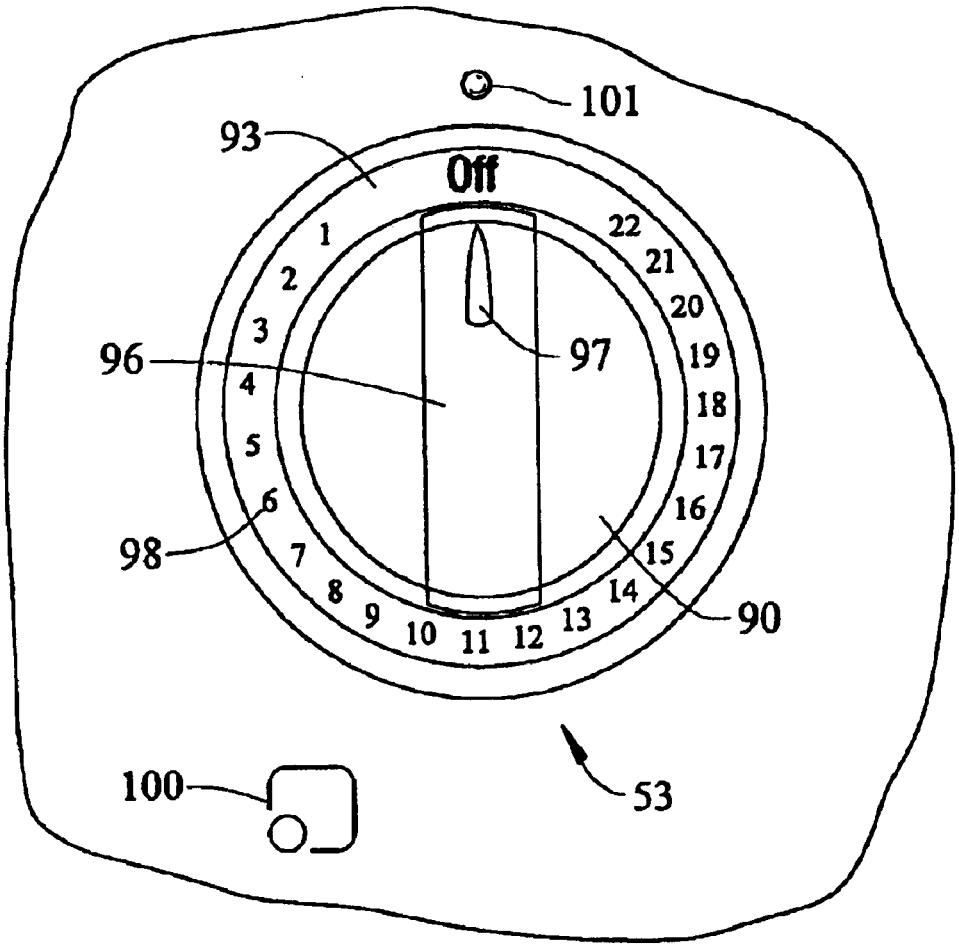
FIG. 3 is an enlarged plan view of one of the plurality of control elements constructed in accordance with the present invention.

As the present invention is particularly directed to the manner in which one or more of control elements 53–57 can be manipulated to control a respective heating element 10–14 through controller 58, reference will now be made to FIGS. 2 and 3 in describing the preferred structure of control elements 53–57 arranged on either side of central display 60 on control panel 50. Since the structure of each control element 53–57 is identical, a detailed description of control element 53 will be made and it is to be understood that control element 54–57 have commensurate structure. In the embodiment shown, control element 53 includes a central portion 90 mounted for rotation within a peripheral ring section 93. Peripheral ring section 93 is provided with a plurality of consecutively numbered power level indicators ranging from, for example, 1–22, with the number 1 corresponding to a low power level and the number 22 corresponding to the highest power level available for the particular heating element 10. Central portion 90 includes an upstanding projection 96 which enables a consumer to grasp and rotate control element 53 relative to peripheral ring 93. In a manner also known in the art, upstanding projection 96 includes a pointer 97 which aides the consumer in selecting a particular power level for the heating element 10. As shown, an icon 100 is provided for indicating the particular heating element 10 associated with the operation of the control element 53. Finally, positioned above control element 53 is an indicator 101 which, in the preferred form, is a light emitting diode or LED. As will be detailed more fully below, indicator 101 aides the consumer in selecting a desired mode of operation for heating element 10.

Having described a preferred construction of cooking appliance 2 and, more particularly, control elements 53–57, a preferred method of operation will be set forth with reference to FIGS. 1 and 3. In accordance with the preferred form of the present invention, controller 58 is adapted to operate heating elements 10–14 according to first and second setting schemes or modes based upon the particular selection made by the consumer. More specifically, through manipulation of one or more of control elements 53–57, the consumer can select a particular power level for the associated heating element 10–14. In a manner known in the art, the first setting scheme activates the associated heating element 10–14 at a power level corresponding to the number indicated by pointer 97 on peripheral ring 93. In the most preferred form of the invention, the first setting scheme is selected by indicating an "even" number setting on peripheral ring 93. That is, upon selection of an even numbered power setting, such as, for example, 2, 4, 6 etc., controller 58 will activate the associated heating element 10–14 at a power level corresponding to the selected even number in order to develop a certain temperature of operation for the particular heating element 10–14.

In further accordance with the most preferred form of the present invention, heating elements 10–14 can also be operated according to a second setting scheme. That is, the consumer, through selection of an "odd" number power level, can operate each of heating elements 10–14 at a first power level that, at the termination of a predetermined time period, automatically switches to a second or lower power level. For example, if one of the plurality of control knobs 53–57 is set on a "7" setting, the initial power level would be that which corresponds to a "9" setting for a period of ten minutes, after which the power level automatically lowers to a "7" setting until the consumer terminates the cooking operation. In another example, if one of the plurality of control knobs 53–57 is set on a "11" setting, the initial power level would be that which corresponds to a "14" setting for a period of 15 minutes, after which the power level automatically lowers to the "11" setting. At this point, it should be understood that the above described power setting and time periods are strictly for exemplary purposes.

To activate the second setting scheme, the consumer need merely select an initial, "odd" number power level. After the control knob, e.g. control knob 53, has come to rest on the "odd" number setting for a second or so, the consumer has the option to make adjustments, preferably within about three seconds. During the three seconds, the knob can be moved to a higher setting for another rest period. A confirmation of the higher setting is provided to the consumer through flashing LED 101, preferably twice. After LED 101 has flashed, the consumer returns the knob to the initial selected power level. Confirmation that the second power setting scheme is activated will be provided to the consumer by multiple flashes of LED 101. To de-activate the second setting scheme, the consumer simply moves the control knob to the off position. In this manner, the heating element corresponding to the control knob will activate at the higher power level for a predetermined period ranging from 5–15 minutes, then automatically return to the selected lower setting. In one preferred embodiment, LED 101 is designed to flash as the consumer rotates the control knob past each odd numbered power levels.

In accordance with another aspect of the invention, LED 101 will remain illuminated during operation of the initial high power level to indicate that the second setting scheme is activated and the heating element is operating at the high power level. In accordance with a further aspect of the invention, controller 58 is linked to digital display 65 which provides the consumer with an alpha or alpha-numeric display indicating that the second setting scheme is active. For example, when the heating element is operating at the higher power level, the word "enhanced" would be displayed on digital display 65.

With this overall arrangement, cooking appliance 2 is provided with three operational modes for performing the cooking operation. In the first mode, cooking appliance 2 operates in a conventional manner. That is, upon selection of certain power levels, e.g., an "even" number setting, a corresponding heating element 10–14 will be activated at the selected power level. In the second mode, the consumer can select a power level, e.g., an "odd" number setting for a corresponding one of heating elements 10–14, wherein the heating element 10–14 will then operate at an initial high power level for a predetermined period, at the end of which heating element 10–14 will automatically lower to the selected power level. In the third and final mode, the consumer selects both a first power level and a second power level. In this mode, the heating element 10–14 will begin heating at the second selected power level. After a predetermined time has elapsed, the heating element 10–14 will automatically lower to the first power level for the remainder of the cooking operation. This overall versatile arrangement enables the consumer to perform other tasks without worrying about cooking at too high a level which could cause food to be burned or otherwise overcooked.

Although described with reference to a preferred embodiment of the invention, it should be readily understood that various changes and/or modifications can be made to the invention without departing from the spirit thereof. For instance, the predetermine time periods could be altered without departing from the scope of the present invention. In addition, while the second setting scheme is disclosed as being associated with odd numbered power levels, it should be understood that even numbers or other power level control schemes, including providing separate control buttons or the like, are equally acceptable. In general, the invention is only intended to be limited by the scope of the following claims.

We claim:

1. A cooking appliance comprising:

a cooktop;

at least one heating element arranged on the cooktop, said heating element being selectively operable at multiple power levels;

at least one control element for establishing a desired power level for the at least one heating element; and a controller linked to the at least one heating element and the at least one control element, said at least one control element being adapted to establish first and second setting schemes for the at least one heating element wherein, upon selection of the first setting scheme, the controller activates the at least one heating element at a selected power level and, upon selection of the second setting scheme, the controller activates the at least one heating element at an initial power level for a predetermined time period, without a user having to set the initial power level, and then automatically reduces the initial power level to the selected power level upon termination of the predetermined time period.

2. The cooking appliance according to claim 1, wherein the at least one control element includes a plurality of consecutive numeric digits, each of said numeric digits being associated with a respective power level.

3. The cooking appliance according to claim 2, wherein the consecutive numeric digits include both even and odd numbers.

4. The cooking appliance according to claim 3, wherein the even numbers are associated with the first setting scheme such that selection of an even numbered power level raises a temperature of the at least one heating element to a level corresponding to the selected even number.

5. The cooking appliance according to claim 2, further comprising: a central graphic display unit arranged on the control panel, said central display including at least one visual indicator being associated with at least the one control element.

6. The cooking appliance according to claim 5, wherein the visual indicator is an LED.

7. The cooking appliance according to claim 5, wherein the control display presents characters in an alpha-format.

8. A cooking appliance comprising:

a cooktop;

at least one heating element arranged on the cooktop, said heating element being selectively operable at multiple power levels;

at least one control element for establishing a desired power level for the at least one heating element, wherein the at least one control element includes a plurality of consecutive numeric digits, each of said numeric digits being associated with a respective power level and wherein the consecutive numeric digits include both even and odd numbers; and a controller linked to the at least one heating element and the at least one control element, said at least one control element being adapted to establish first and second setting schemes for the at least one heating element wherein, upon selection of the fist setting scheme, the controller activates the at least one heating element at a selected power level and, upon selection of the second setting scheme, the controller activates the at least one heating element at an initial power level for a predetermined time period and then automatically reduces the initial power level to the selected power level upon termination of the predetermined time period, wherein one of the even and odd numbers is associated with the first setting scheme and another of the even and odd numbers is associated with the second setting scheme such that selection of the another of the even and odd numbers raises the temperature of the at least one heating element to the initial power level for the predetermined period after which the temperature of the at least one heating element automatically lowers to the selected power level.

9. The cooking appliance according to claim 8, wherein the initial power level of the second setting scheme is selected through the at least one control element.

10. The cooking appliance according to claim 8, wherein the initial power level is automatically established through selection of the selected power level.

11. A cooking appliance comprising:

a cooktop;

at least one heating element arranged on the cooktop, said heating element being selectively operable at multiple power levels;

at least one control element for establishing a desired power level for the at least one heating element; and means for establishing first and second setting schemes for the at least one heating element wherein, upon selection of the first setting scheme, the at least one heating element is operated at a selected power level and, upon selection of the second setting scheme, the at least one heating element is operated at an initial power level for a predetermined time period and then is automatically reduced from the initial cower level to a lower power level upon termination of the predetermined time period, wherein said establishing means operates under one of the first and second setting schemes based on a select one of even and odd number power level settings on the at least one control element, wherein the odd number power level settings are associated with the second setting scheme such that selection of an odd numbered power level raises the temperature of the at least one heating element to the initial power level for the predetermined period after which the temperature of the at least one heating element automatically lowers to the power level corresponding to the selected odd numbered power level.

12. The cooking appliance according to claim 11, wherein the initial power level of the second setting scheme is selected through the at least one control element.

13. The cooking appliance according to claim 11, wherein the initial power level is automatically established through selection of the odd number power level.

14. The cooking appliance according to claim 11, wherein the lower power level is the desired power level.

15. A method of controlling operation of a cooking appliance including a cooktop having at least one heating zone and a controller regulating an operating temperature of the at least one heating zone in accordance with first and second setting schemes comprising:

selecting between first and second setting schemes for the at least one heating zone;

positioning a control element, connected to the controller, to select a desired power level corresponding to a selected one of the first and second setting schemes; and regulating the at least one heating zone to perform a cooking operation in accordance with the selected one of the first and second setting schemes wherein, when the second setting scheme is selected, the at least one heating zone is operated at an initial power level for a predetermined time period, without a user having to set the initial power level, and thereafter automatically lowered to the desired power level.

16. The method of claim 15 wherein, when the first setting scheme is selected, the at least one heating zone is operated at a power level corresponding to the selected power level.

17. The method according to claim 15, wherein the step of positioning the control element to select a desired power level comprises:

selecting a first power level for the at least one heating zone, said first power level being associated with the second operational setting scheme;

selecting a second power level, said second power level being greater than the first power level; and returning the control element to the first power level, wherein the at least one heating zone is operated at the second power level for a first period of time, at the termination of which the at least one heating zone is operated at the first power level.

18. The method of claim 15, further comprising; providing an indication on a display that the heating zone is operating at the initial power level when the cooking appliance is functioning under the second setting scheme.

* * * * *